US006208066B1

(12) United States Patent
Kokubu et al.

(10) Patent No.: US 6,208,066 B1
(45) Date of Patent: Mar. 27, 2001

(54) SEMI-CREEPING DISCHARGE TYPE SPARK PLUG

(75) Inventors: Akio Kokubu; Kazumasa Yoshida, both of Nagoya; Yoshihiro Matsubara, Mie-ken; Makoto Yamaguchi, Aichi-ken, all of (JP)

(73) Assignee: NGK Spark Plug Co., Ltd., Aichi-Ken (JP)

( * ) Notice: Subject to any disclaimer, the term of this patent is extended or adjusted under 35 U.S.C. 154(b) by 0 days.

(21) Appl. No.: 09/035,035

(22) Filed: Mar. 5, 1998

(30) Foreign Application Priority Data

Mar. 7, 1997 (JP) ..... 9-053481
Jan. 28, 1998 (JP) ..... 10-015890

(51) Int. Cl.[7] ..... H01T 13/52
(52) U.S. Cl. ..... 313/141; 313/142; 313/143
(58) Field of Search ..... 313/130, 131 R, 313/141, 142, 143

(56) References Cited

U.S. PATENT DOCUMENTS 2,899,585 8/1959 Dollenberg ..... 313/143
2,957,099 * 10/1960 Dutterer ..... 313/143
5,440,198 * 8/1995 Oshima et al. ..... 313/141
5,448,130 * 9/1995 Matsutani et al. ..... 313/141
5,793,151 8/1998 Kagawa et al. ..... 313/141

FOREIGN PATENT DOCUMENTS 0 765 017 3/1997 (EP) ..... H01T/13/52
7-241612 9/1995 (JP) .
8-1329063 5/1996 (JP) .

* cited by examiner

*Primary Examiner*—Ashok Patel
(74) *Attorney, Agent, or Firm*—Sughrue, Mion, Zinn, Macpeak & Seas, PLLC

(57) ABSTRACT

In a semi-creeping discharge type spark plug, a cylindrical metal shell and an insulator are provided, the latter of which has an axial bore and placed within the metal shell so that a front end of the insulator extends beyond the metal shell. A center electrode is placed within the axial bore of the insulator so that a front end surface edge of the center electrode retracts by 0.1~0.6 mm behind from a front end surface of the insulator. A ground electrode, one end of which is connected to a front end of the metal shell, and the other end of which is bent to oppose an outer surface of the insulator so as to form an air-gap therebetween while permitting creeping spark discharges running along said front end surface of said insulator. A foward edge portion of a front end surface of the ground electrode extends by 0.0~1.0 mm forward from the front end surface of the insulator.

37 Claims, 11 Drawing Sheets

Spark plug A

Number of cycles needed to reduce insulation resistance to 10 MΩ

C=0.2 mm d:Diameter of center electrode

Prior art spark plug J

Fig. 11

Soot fouling resistance, and heat resistance experimental test results

| Height level (Hmm) | Soot fouling resistance experimental test | Heat resistance experimental test |
|---|---|---|
| −0.25 | ○ | × |
| 0 | ○ | ○ |
| 0.25 | ○ | ○ |
| 0.5 | ○ | ○ |
| 0.75 | ○ | ○ |
| 1.0 | ○ | ○ |
| 1.25 | × | ○ |

SEMI-CREEPING DISCHARGE TYPE SPARK PLUG

BACKGROUND OF THE INVENTION

1. Field of the Invention

The invention relates to a semi-creeping discharge type spark plug in which a spark discharge gap is formed by an air-gap and a creeping spark discharge gap through which spark discharges run along a front end surface of an insulator.

2. Description of Prior Art

As shown in FIG. 6, a semi-creeping discharge type spark plug (J) has been known in which a cylindrical metal shell 1 and an insulator 2 are provided, the latter of which has an axial bore 22 and is placed in the metal shell 1 so that a front end of the insulator 2 extends from a front end surface 11 of the metal shell 1. Within the axial bore 22, a center electrode 3 is placed, a front end surface 31 of which is located at a level substantially the same as the front end surface 23 of the insulator 2. L-shaped ground electrodes are provided which is welded to the front end surface 11 of the metal shell 1 as designated at numeral 4. In this situation, the front end surface 31 of the center electrode 3 is generally in flush with a forward edge portion 42 of a front end surface 41 of the ground electrode 4. Upon applying a high voltage across the electrodes 3, 4, spark discharges creep along the front end surface 23 of the insulator 2.

In a provisional publication No. 0765017 published on Mar. 26, 1997 under EPO, a semi-creeping discharge type spark plug similar to that of FIG. 6 has been disclosed which however remains silent about a geometrical dimensional relationship between the front end surface of the insulator and the forward edge portion of the front end surface of the ground electrode. Upon considering the purposes of the invention disclosed in the provisional publication No. 0765017, the publication puts an emphasis on a prevention of the channeling phenomenon rather than an avoidance of the soot fouling to insure an extended service life. On the contrary, the present invention makes much of preventing the soot fouling even though permitting the channeling phenomenon in a tolerable degree.

As well known for those versed in the art, this type of the spark plugs are, in fact, superior to a general air-gap type spark plug in the point of fouling resistance because the formers are to burningly evaporate the carbon-related deposit collected on the front end surface of the insulator.

In those semi-creeping discharge type spark plugs, it is, however, recognized that the insulation resistance reduces due to the carbon-related deposit (FIG. 9) when the fouling resistance experimental test was carried out under very cold conditions (−15° C.) in conformity with a predelivery pattern in FIG. 4 as described in detail hereinafter. Besides insuring a desirable fouling resistant property, it has generally been demanded to impart a good heat resistant property to a semi-creeping discharge type spark plug without inviting unfavorable channeling phenomenon.

Therefore, it is a main object of the invention to provide a semi-creeping discharge type spark plug which is capable of concurrently insuring a good heat resistance and fouling resistance so as to maintain a desirable insulation resistance for an extended period of time.

SUMMARY OF THE INVENTION

According to the present invention, there is provided a semi-creeping discharge type spark plug having a ground electrode, one end of which is connected to a front end of the metal shell, and the other end of which is bent to oppose an outer surface of the insulator so as to form an air-gap therebetween, a foward edge portion of a front end surface of the ground electrode extending by 0.0~1.0 mm from the front end surface of the insulator. A spark gap between a front end surface of the ground electrode and a front end surafce of the center electrode, is formed by the air-gap and a creeping spark discharge gap through which spark discharges creep along the front end surface of the insulator. The center electrode is placed within the axial bore of the insulator so that a front end surface edge of the center electrode retracts inward by 0.1~0.6 mm from the front end surface of the insulator. The front end surface edge of the center electrode acts as an emitting segment or receiving segment of the spark discharges.

When the forward edge portion of the ground electrode is located behind the front end surface of the insulator, the heat resistant property is likely to reduce which is especially important upon running an internal combustion engine consecutively at high speed. This is because the spark discharges are supposed to occur across the air-gap between the ground electrode and insulator in order to ignite the air-fuel mixture injected into a combustion chamber. At the time of igniting the air-fuel mixture, the combustion spreads into a cylinder of the internal combustion engine to expose the insulator directly to the combustion flames. This may result in an excessive temperature rise of the front end of the insulator to reduce the heat resistance of the insulator to an unacceptable degree.

When the forward edge portion of the ground electrode is located forward by 1.0 mm or more from the front end surface of the insulator, the spark discharges is likely to converge into a steady path without colliding agaist the outer surface of the insulator. This reduces the fouling resistance which affects particularly on the cold starting capability of the engine, and at the same time, inducing the channeling at the front end surface of the insulator which adversely influences the heat resistant property upon running the engine continuously at high speed. By way of illustration, a heat resistance exprimental test result data are shown in FIG. 11 in which an insulator nose is 13 mm, and a diameter of the front end of the insulator is 4.0 mm while a diameter of the center electrode is 2.0 mm, and a distance between the forward edge portion of the ground electrode and the front end surface of the insulator is 0.0~0.5 mm.

With the front end edge of the center electrode retracted by 0.1 mm or more behind from the front end surface of the insulator, it is possible to creep the spark discharges appropriately along the front end surface of the insulator when permitting the spark discharge between the front end surface of the center electrode and the ground electrode. This facilitates the self-cleaning action to burningly evaporate the carbon-related deposit collected on the front end surface of the insulator. When the front end edge of the center electrode is located by more than 0.6 mm behind from the front end surface of the insulator, it supposedly quickens the progress of the channeling.

With the front end edge of the center electrode retracted by 0.1~0.6 mm behind from the front end surface of the insulator, and the forward edge portion of the ground electrode located by 0.0~1.0 mm forward from the front end surface of the insulator, it is possible to insure the good heat resistance and fouling resistance at once without sacrificing the channeling resistance.

With the diameter of the front end of the center electrode thinned to 2.0 mm or less, it is possible to induce the spark discharges with a relatively low discharge voltage so as to meliorate the ignitability and fouling resistance by facilitating the self-cleaning action. From a point of preventing the spark erosion of the center electrode, it is necessary to increase the diameter of the front end of the center electrode to 1.0 mm or more (preferably 1.6 mm or more).

With an inner edge portion of the front end surface of the insulator beveled by 0.1~1.0 mm (preferably 0.2~0.8 mm) in terms of chamfer length (C) or rounded by 0.1~1.0 1/mm (preferably 0.2~0.8 1/mm) in terms of radius of curvature (R), it is possible to weaken an attraction of the spark discharges against the beveled or rounded surface so as to effectively reduce the channeling with the least damage done thereon. When the chamfer length (C) or the radius of curvature (R) exceeds 1.0 mm (1.0 mm 1/mm), it reduces the fouling resistance while deteriorating the physical strength of the insulator.

By providing a plurality of ground electrodes (preferably three or four), it is possible to diverge the spark discharge paths so as to prevent the spark erosion with the least channeling. This also facilitates the self-cleaning action due to the spark discharges so as to meliorate the fouling resistance.

With a front end including the front end surface edge of the center electrode made of a spark erosion resistant metal tip, it is possible to improve the spark erosion resistant property of the center electrode, despite that the front end surface edge of the center electrode is likely to be spark eroded.

BRIEF DESCRIPTION OF THE DRAWINGS

FIG. 11 is an explanatory view of experimental test result data on the fouling resistance and heat resistance obtained by varying a distance between a forward edge portion of a ground electrode and the front end surface of the insulator.

DETAILED DESCRIPTION OF THE PREFERRED EMBODIMENT OF THE INVENTION

Figure 1:
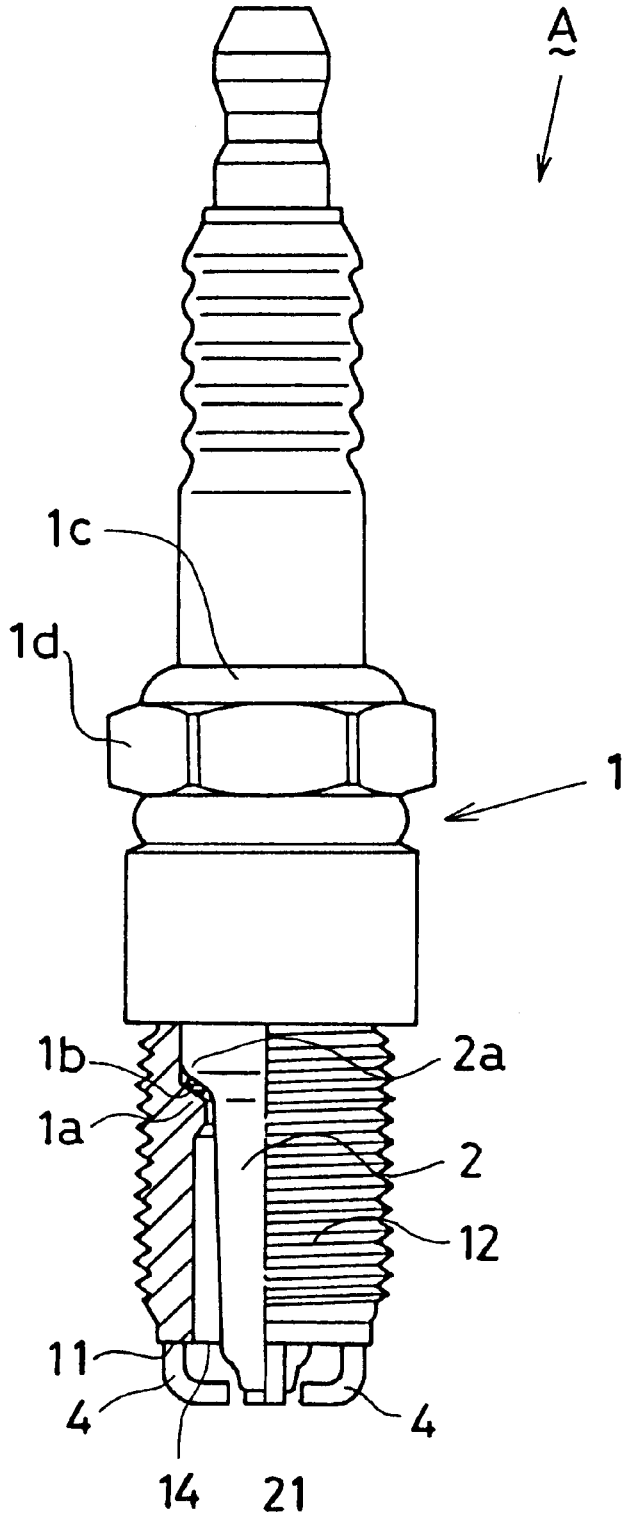
FIG. 1 is a plan view of a semi-creeping discharge type spark plug (A) according to a first embodiment of the invention.
Figure 2:
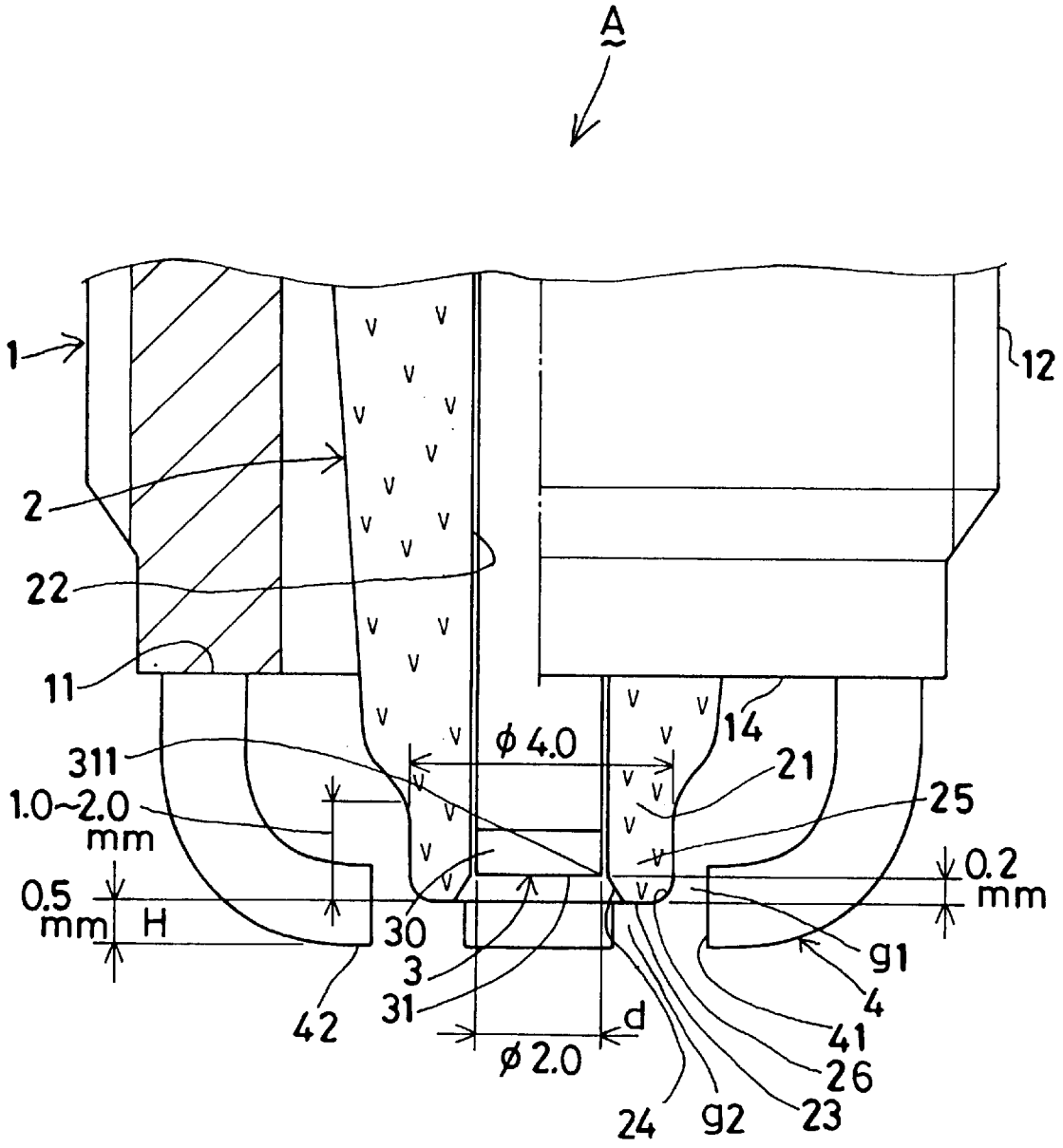
FIG. 2 is a longitudinal cross sectional view of a front portion of the semi-creeping discharge type spark plug (A)

Referring to FIGS. 1~5 which show a semi-creeping discharge type spark plug (A) according to a first embodiment of the invention, the spark plug (A) has a cylindrical metal shell 1 and a tubular insulator 2, an inner space of which serves as an axial bore 22 (approx. 2.0 mm in diameter). The insulator 2 is placed within the metal shell 1 so that a front end of 21 of the insulator 2 extends beyond a front end 11 of the metal shell 1. Within the axial bore 22 of the insulator 2, a center electrode 3 is fixedly supported. As designated at numeral 4 in FIGS. 1 and 2, four L-shaped ground electrodes are welded to the front end 11 of the metal shell 1. A front end surface 41 of each ground electrode 4 measures, for example, 1.1 mm in thickness and 2.2 mm in breadth.

The metal shell (low carbon steel) 1 has a male threaded portion (M14) 12 through which the spark plug (A) is to be mounted on a cylinder head of an internal combustion engine by way of a gasket (not shown).

The insulator 2 is made of a ceramic material with alumina as a main ingredient. The insulator 2 has a stepped portion 2*a* which rests on a shoulder portion 1*a* of the metal shell 1 by way of a packing 1*b* so as to stabilize the insulator 2 within the metal shell 1. By caulking a rear tail portion 1*c* of a hex nut 1*d* of the metal shell 1 against the insulator 2, the insulator 2 is fixedly stabilized with its front end 21 extended beyond a front open end 14 of the metal shell 1.

The insulator 2 has a front end surface 23 substantially formed into a flat-shaped configuration so as to smoothly accept the semi-creeping spark discharges therealong. As designated by numeral 24 in FIG. 2, an inner edge portion of the front end surface 23 is beveled by 0.2 mm in terms of chamfer length (C). In order to insure the channeling resistance without losing a good fouling resistance, the inner edge portion of the front end surface 23 is beveled preferably by 0.2~0.8 mm in terms of chamfer length (C) or otherwise rounded by 0.2~0.8 (1/mm) in terms of radius of curvature (R).

Further, the front end 21 of the insulator 2 has a straight portion 25 diametrically constricted to measure 3.0~4.0 mm in diameter and 1.0~2.0 mm in length. The presence of the straight portion 25 facilitates the self-cleaning action, and at the same time, making it easy to form an air-gap (g1) between an outer surface 26 of the insulator 2 and a front end surface 41 of the ground electrode 4.

The center electrode (2.0 mm in diameter) 3 has a nickel-based alloy (e.g., Ni—Si—Mn—Cr: NCF600) in which a heat conductor copper core is embedded. To a forward end of the center electrode 3, a disc-shaped noble metal tip 30 is welded, a front end surface of which acts as a front end surface 31 of the center electrode 3. The disc-shaped noble metal tip 30 is made of Pt-20Ni based alloy, and measures 2.0 mm in diameter and 0.5 mm in thickness. Instead of Pt-20Ni based alloy, the noble metal tip 30 may be made of other spark erosion resistant metals such as Pt, Pt-based alloy, Ir-based alloy, Ir—Rh based alloy, W—Re based alloy, highly chromium-contained alloy or the like.

In this instance, the front end surface 31 (equivalent to a front end edge 311) of the center electrode 3 is retracted by 0.2 mm behind from the front end surface 23 of the insulator 2.

The ground electrode 4 is made of a nickel-based alloy (e.g., NCF600) and bent so that the front end surface 41 opposes the front end edge 311 of the center electrode 3 while forming the air-gap (g1) with the outer surface 26 of the insulator 2. Upon applying a high voltage between the electrodes 2, 4, the spark discharges runs through the air-gap (g1) and a creeping spark discharge gap (g2) between the front end surface 31 of the center electrode 3 and the front end surface 41 of the ground electrode 4.

The ground electrode 4 has a forward edge portion 42 which extends by e.g., 0.5 mm forward from the front end surface 23 of the insulator 2. This arrangement makes it possible to insure the good fouling resistance without sacrificing the good heat resistant property as evidenced in detail hereinafter.

Figure 3:
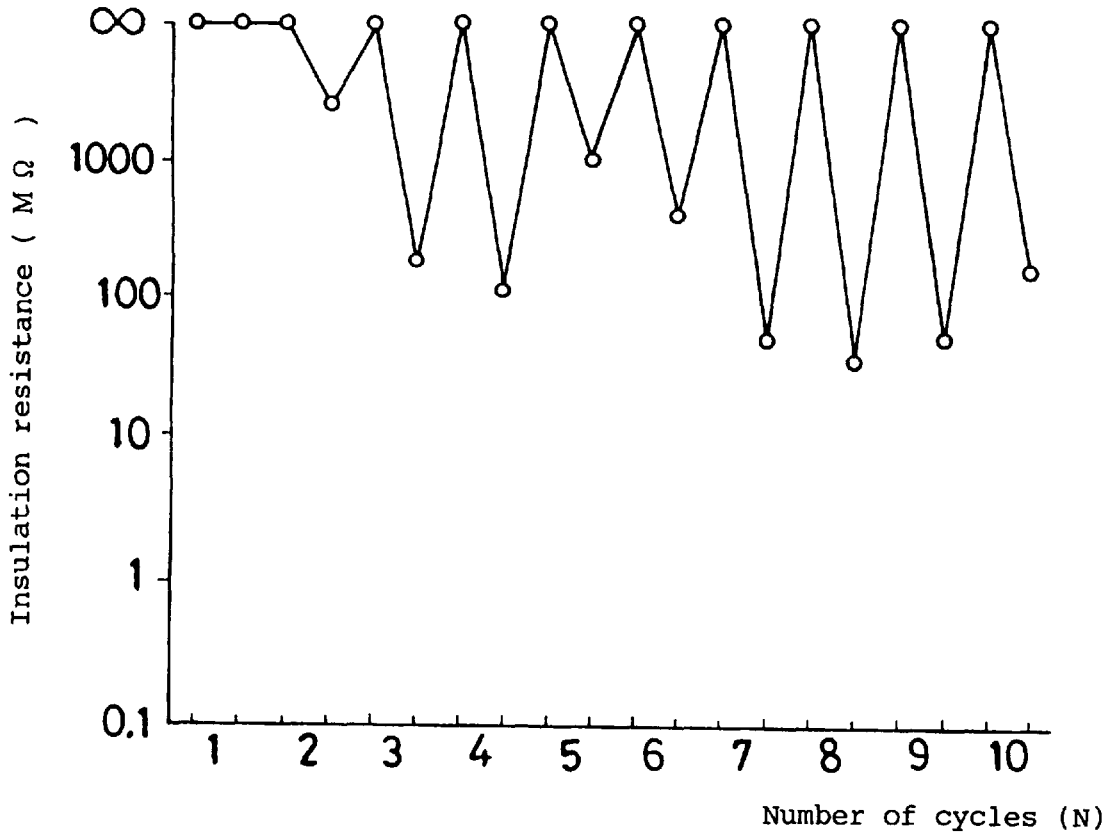
FIG. 3 is a graphical representation showing a relationship between an insulation resistance and the number of cycles in accordance with the spark plug (A)

FIG. 3 shows a relationship between an insulation resistance (MΩ) and the number of cycles (N) with a predelivery pattern incorporated into a fouling resistant experimental test. Upon carrying out the fouling resistant experimental test, a 2500 cc, straight line, 6-cylinder, four-valve DOHC engine was placed on a chassis dynamometer under a cold room temperature (−15° C.) with the semi-creeping discharge type spark plug (A) mounted thereon. The fouling resistant experimental test is in conformity with the paragraph 5.2 (1) JIS D1606 on the assumption that the engine is cold started along the predelivery pattern of FIG. 4 at the heavy traffic congestion in extremely cold districts. With the use of a megohmmeter (commonly called as "Megger"), the insulation resistance values were measured after the end of each cycle.

Figure 6:
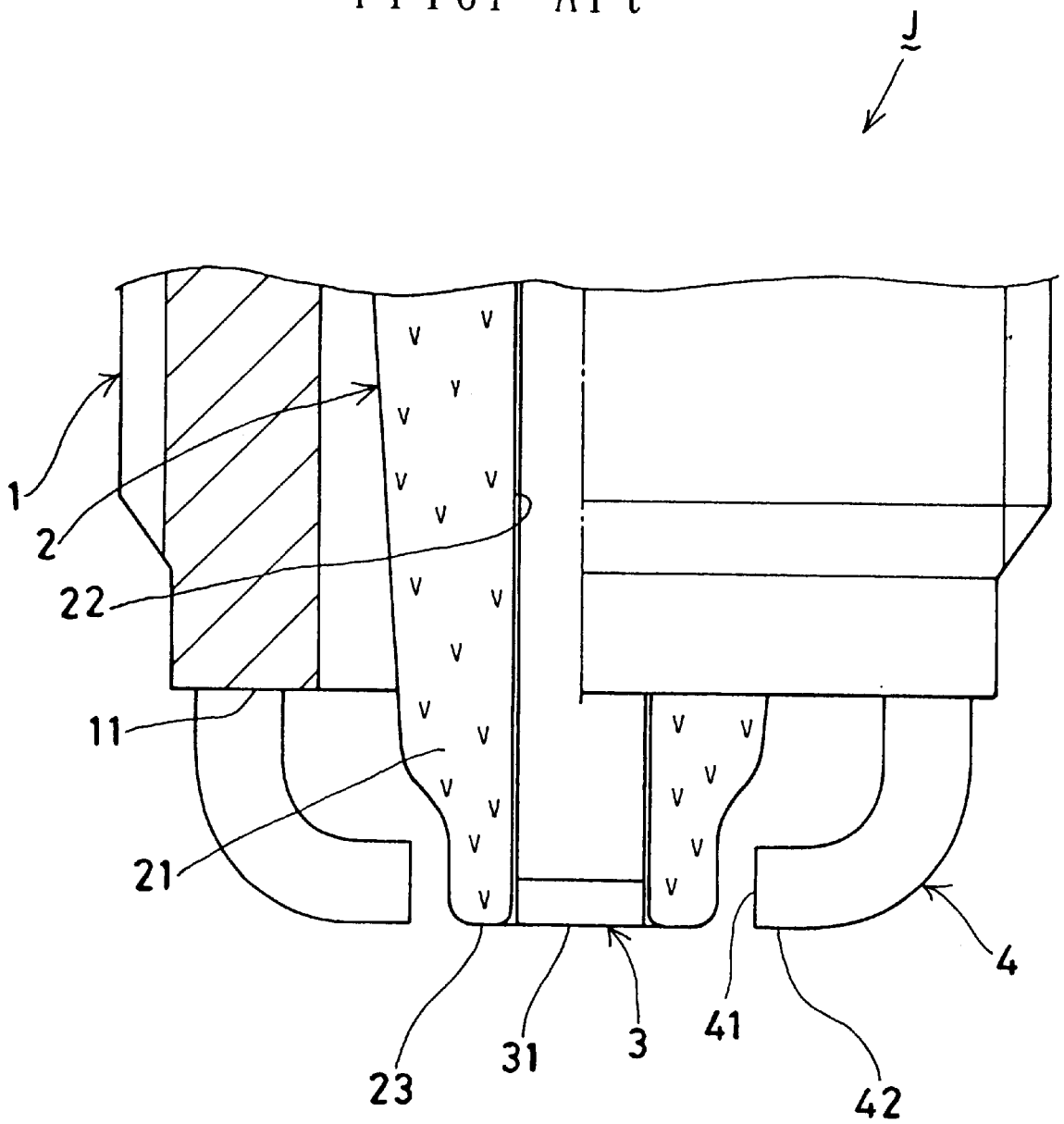
Fig. 6 Prior Art
FIG. 6 is a plan view of a front portion of a prior art semi-creeping discharge type spark plug (J)

As apparent by comparing the graphical representation of the semi-creeping discharge type spark plug (A) in FIG. 3 to the prior art spark plug (J) of FIG. 6, it is possible in the semi-creeping discharge type spark plug (A) to maintain the insulation resistance value over 10M Ω without sacrificing the good fouling resistance.

Figure 5:
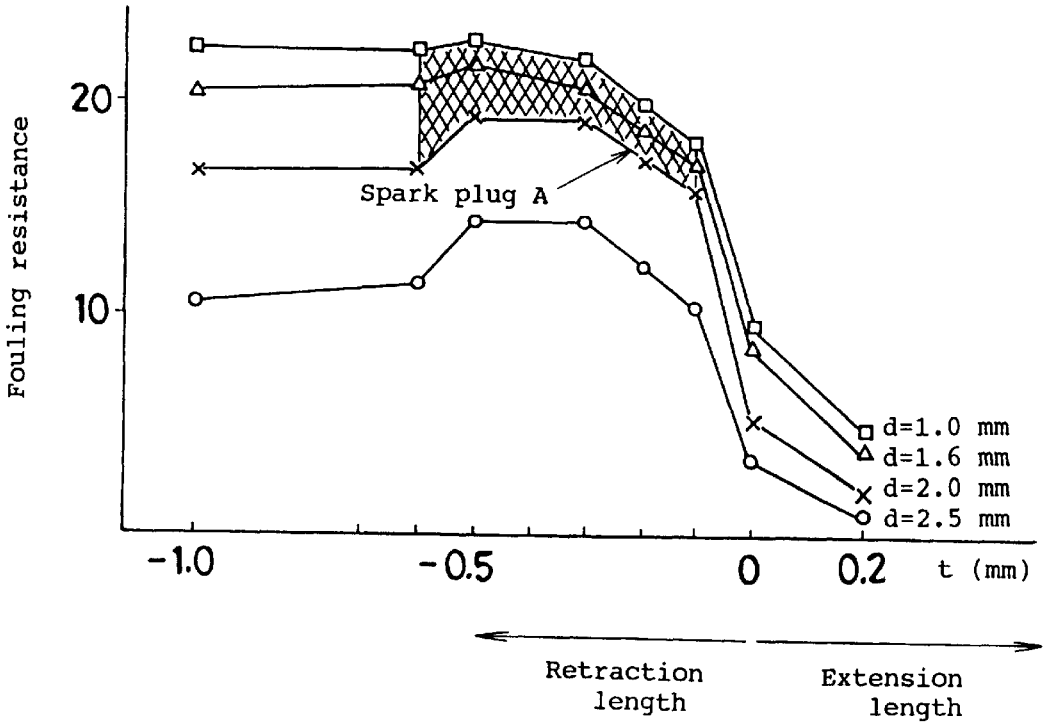
FIG. 5 is a graphical representation showing how a fouling resistance (number of cycles (N) needed to reduce by 10 MΩ) changes depending on how far a front end surface of a center electrode extends beyond or retracts from a front end surface of an insulator.

FIG. 5 shows how the fouling resistance changes depending on how far the front end surface 31 of the center electrode 3 extends beyond or retracts from the front end surface 21 of the insulator 2. In this instance, the fouling resistance was measured in terms of the number of cycles (N) needed to reduce the insulation resistance by 10 M Ω.

32 types of spark plug specimens were prepared in the following combinations.

d: 1.0 mm, 1.6 mm, 2.0 mm and 2.5 mm.

t: −1.0 mm, −0.6 mm, −0.5 mm, −0.3 mm −0.2 mm, −0.1 mm, 0.0 mm and +0.2 mm.

Where (d) is a diameter of the noble metal tip 30 and the front end of the center electrode 3, (t) is a length how far the front end surface 31 of the center electrode 3 extends beyond or retracts from the front end surface 21 of the insulator 2, which are in turn designated as an extension length (positive number) and retraction length (negative numbers).

Figure 4:
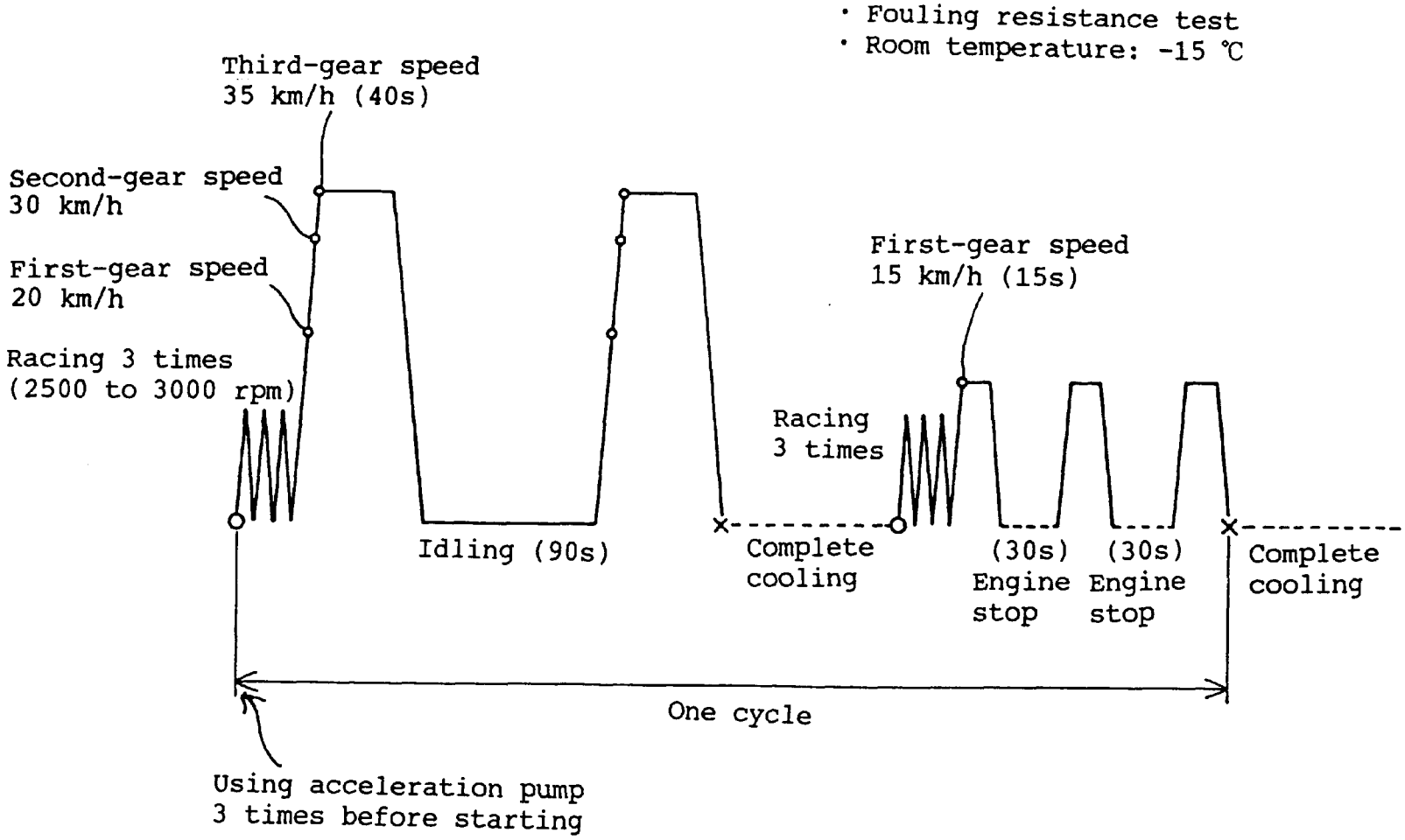
FIG. 4 is an explanatory view of a predelivery pattern.

Upon carrying out a fouling resistant experimental test, the engine was placed on the chassis dynamometer under the cold room temperature (−15° C.) with the spark plug specimens respectively mounted thereon in conformity with the predelivery pattern (paragraph 5.2 (1) JIS D1606) in FIG. 4. In this instance, the experimental test results in FIG. 5 is depicted by plotting the number of cycles firstly reduced to 10 M Ω or less.

From the experimental test results in FIG. 5, it was found that the good fouling resistance is maintained so long as the front end surface 31 of the center electrode 3 retracts by 0.1 mm or more behind from the front end surface 23 of the insulator 2.

However, it becomes unacceptable when the retraction length (t) exceeds 0.6 mm because it quickens the progress of channeling and damage done on the front end surface 23 of the insulator 2. When determining an inequality relationship between the retraction length (t), the chamfer (C) and the radius of curvature (R), the sign of inequality is indicated by (t) mm<C, R<(t+0.1) mm.

Although the preferable fouling resistance maintained when the diameter (d) of the front end of the center electrode 3 is 2.0 mm or less as indicated in FIG. 5, it is necessary to define the diameter (d) to 1.0 mm or more (preferably 1.6 mm or more) from the point of preventing an unacceptable amount of the spark erosion and the channeling due to the concentrated spark discharge paths.

Insomuch as the retraction length (t) occupies within a bound as depicted by the double hatched region of FIG. 5, the following advantages are obtained.

(a) Because the front end surface 31 of the center electrode 3 retracts by 0.1 mm or more behind from the front end surface 23 of the insulator 2, it is possible to dominantly creep the spark dicharges along the front end surface 23 of the insulator 2 so as to facilitate the self-cleaning action with the good fouling resistance.

Besides the four ground electrodes 4 provided to diverge the spark discharges, the forward edge portion 42 is located by 0.5 mm forward from the front end surface 23 of the insulator 2 with the retraction length (t) as 0.6 mm, it is possible to significantly delay the damage, flaking and channeling given to the front end surface 23 of the insulator 2.

(b) With the front end of the center electrode 3 thinned to 2.0 mm or less in diameter (d), it is possible to favorably meliorate the ignitability. However, the diameterical dimension (d) brings no substantial influence on the good erosion resistant property because the front end of the center electrode 3 is not so thinned as to be short of 1.0 mm.

(c) With the inner edge of the front end surface 23 of the insulator 2 beveled by 0.2 mm in terms of chamfer length (C), it is possible to delay the channeling of the insulator 2 because the attraction of the spark discharges against the beveled portion 24 is weakened.

(d) With the noble metal tip 30 provided on the center electrode 3, it is possible to decrease an amount of the spark erosion so as to ameliorate the spark erosion resistant property of the center electrode 3.

Figure 7:
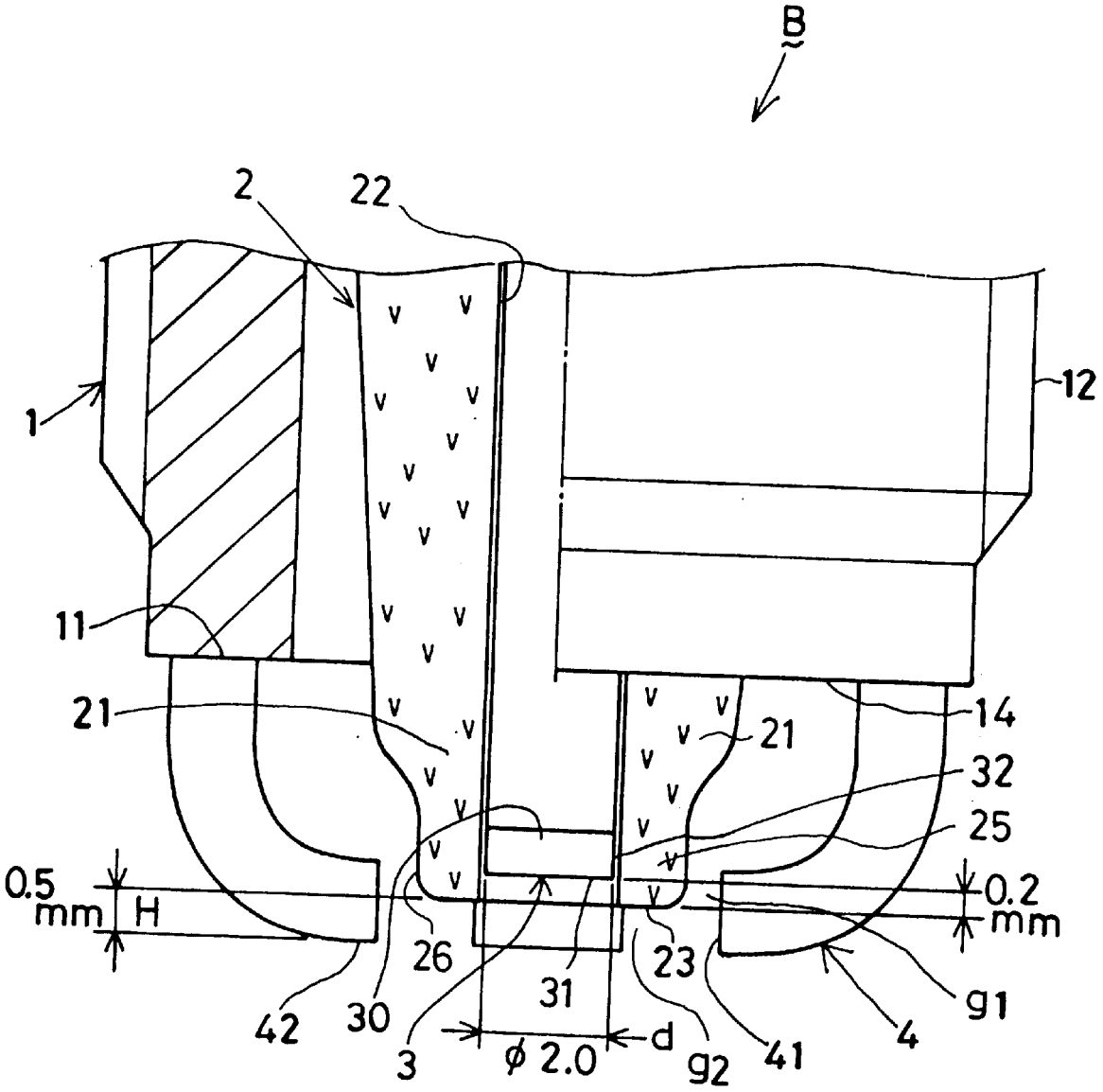
FIG. 7 is a longitudinal cross sectional view of a front portion of a semi-creeping discharge type spark plug (B) according to a second embodiment of the invention.
Figure 8:
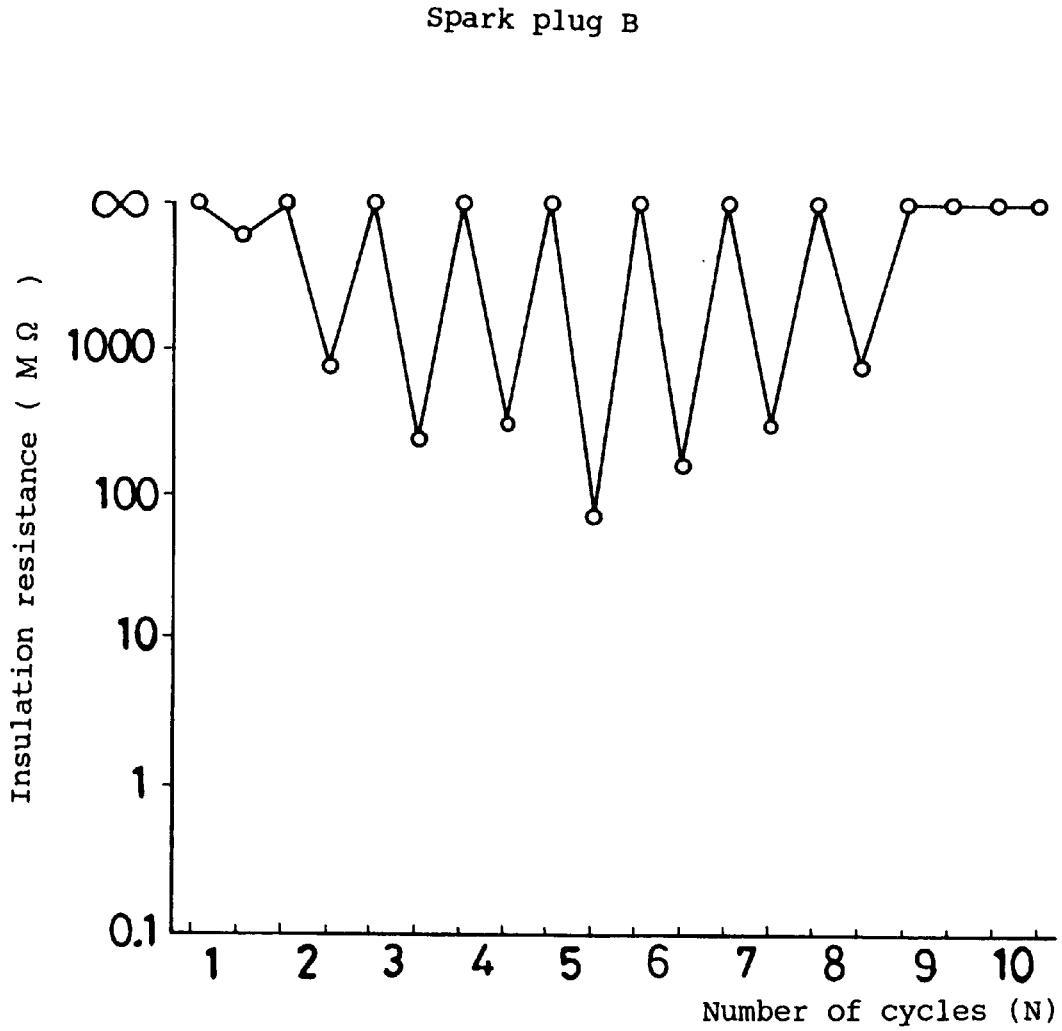
FIG. 8 is a graphical representation showing a relationship between an insulation resistance and the number of cycles in accordance with the spark plug (B)
Figure 9:
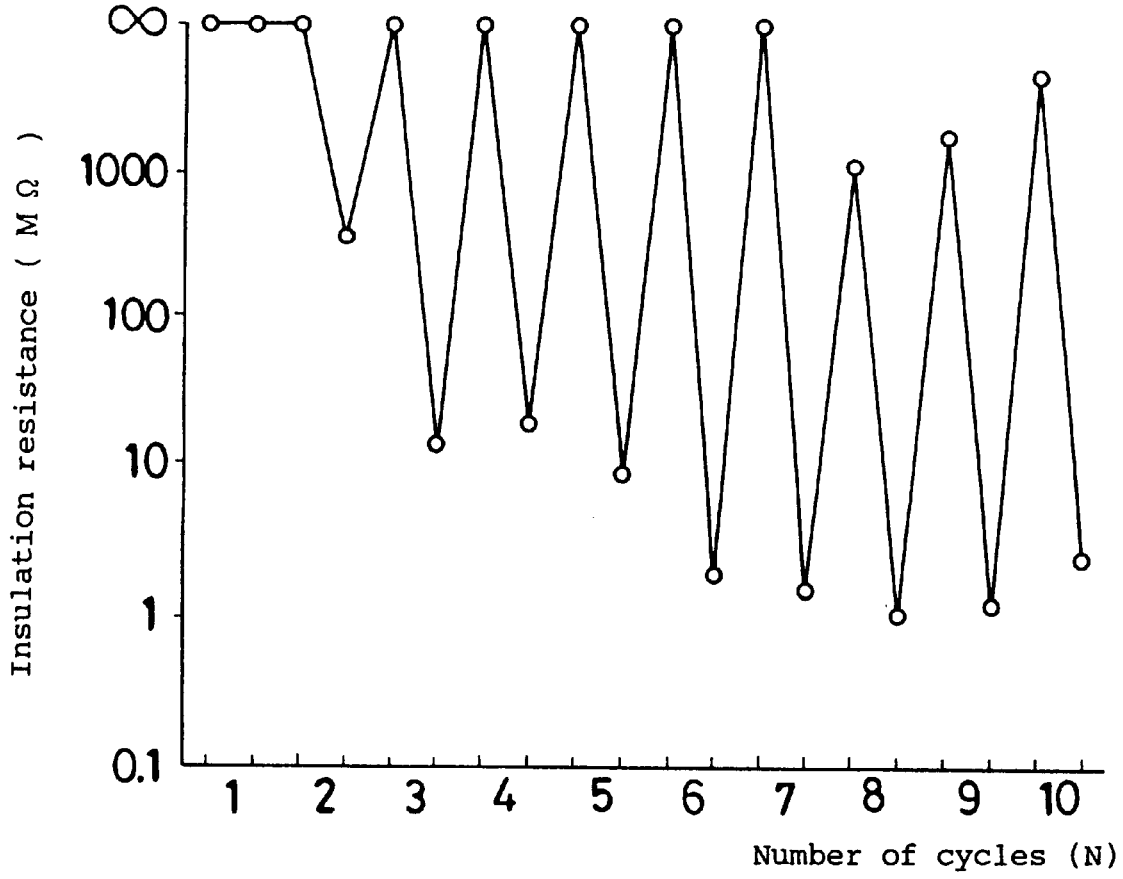
FIG. 9 is a graphical representation showing a relationship between an insulation resistance (M Ω) and the number of cycles (N) in accordance with the prior art spark plug (J)

FIGS. 7 and 8 show a second embodiment of the invention in which a semi-creeping discharge type spark plug (B) is provided. The spark plug (B) is quite similar structurally to the first embodiment of the invention of FIGS. 1 and 2 except for the bevelled portion 24 which the semi-creeping discharge type spark plug (A) has.

FIG. 8 shows a relationship between an insulation resistance (MΩ) and the number of cycles (N) with the predelivery pattern incorporated into a fouling resistant experimental test. Upon carrying out the experimental test, a 2500 cc, straight line, 6-cylinder, four-valve DOHC engine was placed on the chassis dynamometer under the cold room temperature (−15° C.) with the semi-creeping discharge type spark plug (B) mounted thereon. The fouling resistant experimental test was conducted in the same manner as described above. With the use of the megohmmeter, the insulation resistance values were also measured after the end of each cycle.

From the graph of FIG. 8, it was found that the insulation resistance value exceeds 50 MΩ with the good fouling resistance, which is somewhat preferable than the semi-creeping discharge type spark plug (A) had exhibited. In the semi-creeping discharge type spark plug (A), it is possible to obtain the same advantages as listed in the items (a), (b) and (d).

FIG. 11 is a chart depicted to show how the soot fouling resistance and the heat resistance are changed depending on a height level (H) which represents how far the forward edge portion 42 of the ground electrode 4 is removed from the front end surface 23 of the insulator 2. A soot fouling experimental test was carried out along the predelivery pattern (paragraph 5.2 (1) JIS D1606) with the retraction length (t) and the thickness of the front end surface 41 as 0.2 mm and 1.3 mm respectively.

In this instance, the engine was placed on the chassis dynamometer under the cold room temperature (−15° C.), and the height level (H) was altered in turn to −0.25 mm, 0.0 mm, 0.25 mm, 0.5 mm, 0.75 mm, 1.0 mm and 1.25 mm.

The heat resistance experimental test was carried out with the spark plug (B) mounted on a 4-cylinder, 1. 6L engine while advancing an angle of the ingition timing, and at the same time, varying the height level (H) in the same manner as described above.

In the soot fouling resistance experimental test, an estimation was held with the number of cycles needed to firstly reduce the insulation resistance value to 10 M Ω or less as a criterion. In the heat resistance experimental test, an estimation was made with the ignition timing leading close to preignition as a criterion. In the chart of FIG. 11, circle (○) represents when the number of cycles was six or less, and crisscross (x) represents when the number of cycles was short of six in the soot fouling resistance experimental test. In the heat resistance experimental test, the circle (○) represents when the ignition timing was 38° or more in terms of BTDC (Before Top Dead Center), and the crisscross (x) represents when the ignition timing was short of 38° in terms of BTDC.

Such is the above experimental test results that the heat resistance is considerably ameliorated while the soot fouling resistance reduces with the increase of the height level (H) which represents how far the forward edge portion 42 of the ground electrode 4 is removed from the front end surface 23 of the insulator 2.

In order to concurrently satisfy the good starting capability in a cold environment and the good heat resistance when running the engine consecutively at high speed, it is necessary to determine the height level (H) to be in the range from 0.0 to 1.0 mm.

Figure 10:
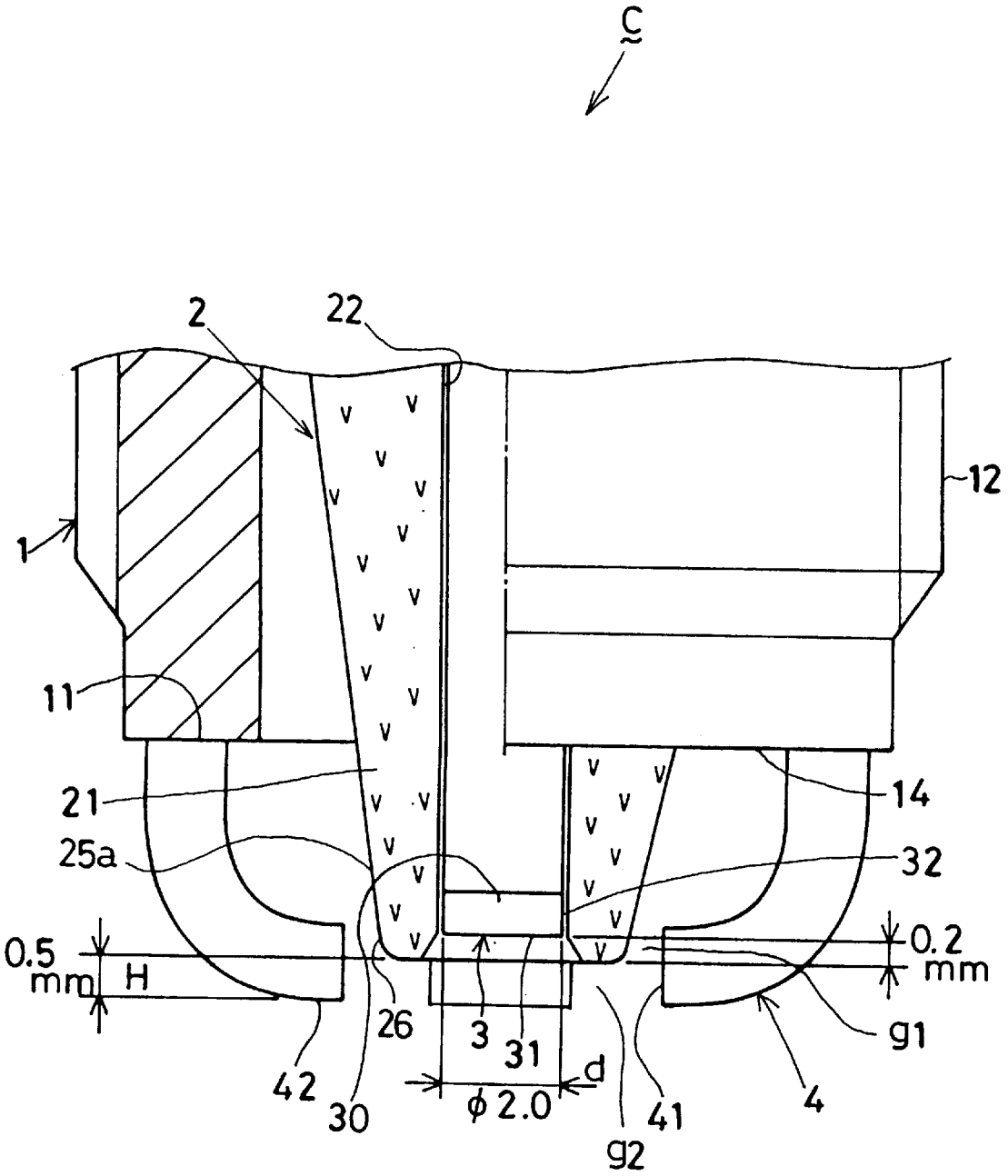
FIG. 10 is a longitudinal cross sectional view of a front portion of a semi-creeping discharge type spark plug (C) according to a third embodiment of the invention.

FIG. 10 shows a third embodiment of the invention in which a semi-creeping discharge type spark plug (C) is provided to be structurally similar to the spark plug (A) except that a tapered portion 25*a* is continuously formed from the front portion of the insulator 2 instead of the constricted straight portion 25.

After carrying out the experimental test in conformity with the predelivery pattern (paragraph 5.2 (1) JIS D1606) of FIG. 4, it was found that the spark plug (C) has exhibited substantially as good a fouling resistance as attained by the spark plug (A).

It is to be noted that a spark erosion resistant material may be used only to the front end of the insulator 2 so as to form a composite structure as a whole.

It is also to be observed that the ground electrode 4 may be formed in integral with the metal shell 1 in lieu of welding discretely to the front end surface 11 of the metal shell 1.

What is claimed is:

1. A semi-creeping discharge type spark plug comprising:

a cylindrical metal shell;

an insulator having an axial bore provided within said metal shell so that a front end of said insulator extends beyond said metal shell, a portion of said insulator front end being diametrically constricted with respect to the remainder of said insulator, the constricted portion having an axial length of 1.0 −2.0 mm;

a center electrode provided within said axial bore of said insulator so that a front end surface edge of said center electrode is retracted by 0.1~0.6 mm from a front end surface of said insulator; and at least one ground electrode, one end of which is connected to a front end of said metal shell, and the other end of which is bent to oppose an outer surface of said insulator so as to form an air-gap therebetween while permitting creeping spark discharges running along said front end surface of said insulator, a forward edge portion of a front end surface of said ground electrode extending by 0.0~1.0 mm forward from said front end surface of said insulator.

2. A semi-creeping discharge type spark plug according to claim 1, wherein an outer diameter of a front end of said center electrode is 1.0~2.0 mm, a front end portion of which opposes said ground electrode and is enclosed by said insulator.

3. A semi-creeping discharge type spark plug, comprising:

a cylindrical metal shell;

an insulator having an axial bore provided within said metal shell so that a front end of said insulator extends beyond said metal shell;

a center electrode provided within said axial bore of said insulator so that a front end surface edge of said center electrode is retracted by 0.1~0.6 mm from a front end surface of said insulator; and at least one ground electrode, one end of which is connected to a front end of said metal shell, and the other end of which is bent to oppose an outer surface of said insulator so as to form an air-gap therebetween while permitting creeping spark discharges running along said front end surface of said insulator, a forward edge portion of a front end surface of said ground electrode extending by 0.0~1.0 mm forward from said front end surface of said insulator, wherein an inner edge portion of said front end surface of said insulator which is subjected to the spark discharges from said ground electrode to said center electrode, is beveled by greater than 0.5 mm to 1.0 mm in terms of chamfer length (C).

4. A semi-creeping discharge type spark plug, comprising:

a cylindrical metal shell;

an insulator having an axial bore provided within said metal shell so that a front end of said insulator extends beyond said metal shell;

a center electrode provided within said axial bore of said insulator so that a front end surface edge of said center electrode is retracted by 0.1~0.6 mm from a front end surface of said insulator; and at least one ground electrode, one end of which is connected to a front end of said metal shell, and the other end of which is bent to oppose an outer surface of said insulator so as to form an air-gap therebetween while permitting creeping spark discharges running along said front end surface of said insulator, a forward edge portion of a front end surface of said ground electrode extending by 0.0~1.0 mm forward from said front end surface of said insulator, wherein an outer diameter of a front end of said center electrode is 1.0–2.0 mm, a front end portion of which opposes said ground electrode and is enclosed by said insulator; and wherein an inner edge portion of said front end surface of said insulator which is subjected to the spark discharges from said ground electrode to said center electrode, is beveled by greater than 0.5 mm to 0.1 mm in terms of chamfer length (C).

5. A semi-creeping discharge type spark plug according to claim 1, wherein a plurality of said ground electrodes are provided in a fashion to oppose said center electrode.

6. A semi-creeping discharge type spark plug according to claim 2, wherein a plurality of said ground electrodes are provided in a fashion to oppose said center electrode.

7. A semi-creeping discharge type spark plug according to claim 3, wherein a plurality of said ground electrodes are provided in a fashion to oppose said center electrode.

8. A semi-creeping discharge type spark plug according to claim 4, wherein a plurality of said ground electrodes are provided in a fashion to oppose said center electrode.

9. A semi-creeping discharge type spark plug according to claim 1, wherein a front end including said front end surface edge of said center electrode is made of a spark erosion resistant metal tip.

10. A semi-creeping discharge type spark plug according to claim 2, wherein a front end including a front end surface edge of said center electrode is made of a spark erosion resistant metal tip.

11. A semi-creeping discharge type spark plug according to claim 3, wherein a front end including a front end surface edge of said center electrode is made of a spark erosion resistant metal tip.

12. A semi-creeping discharge type spark plug according to claim 4, wherein a front end including a front end surface edge of said center electrode is made of a spark erosion resistant metal tip.

13. A semi-creeping discharge type spark plug according to claim 5, wherein a front end including a front end surface edge of said center electrode is made of a spark erosion resistant metal tip.

14. A semi-creeping discharge type spark plug according to claim 6, wherein a front end including a front end surface edge of said center electrode is made of a spark erosion resistant metal tip.

15. A semi-creeping discharge type spark plug according to claim 9, wherein said spark erosion resistant metal tip is formed by a metal selected from the group consisting of Pt, Pt-based alloy, Ir, Ir-based alloy and Ir—Rh based alloy.

16. A semi-creeping discharge type spark plug according to claim 10, wherein said spark erosion resistant metal tip is formed by a metal selected from the group consisting of Pt, Pt-based alloy, Ir-based alloy and Ir—Rh based alloy.

17. A semi-creeping discharge type spark plug according to claim 11, wherein said spark erosion resistant metal tip is formed by a metal selected from the group consisting of Pt, Pt-based alloy, Ir-based alloy and Ir—Rh based alloy.

18. A semi-creeping discharge type spark plug according to claim 12, wherein said spark erosion resistant metal tip is formed by a metal selected from the group consisting of Pt, Pt-based alloy, Ir-based alloy and Ir—Rh based alloy.

19. A semi-creeping discharge type spark plug according to claim 13, wherein said spark erosion resistant metal tip is formed by a metal selected from the group consisting of Pt, Pt-based alloy, Ir-based alloy and Ir—Rh based alloy.

20. A semi-creeping discharge type spark plug according to claim 14, wherein said spark erosion resistant metal tip is formed by a metal selected from the group consisting of Pt, Pt-based alloy, Ir-based alloy and Ir—Rh based alloy.

21. A semi-creeping discharge type spark plug, comprising:

a cylindrical metal shell;

an insulator having an axial bore provided within said metal shell so that a front end of said insulator extends beyond said metal shell;

a center electrode provided within said axial bore of said insulator so that a front end surface edge of said center electrode is retracted by 0.1~0.6 mm from a front end surface of said insulator; and at least one ground electrode, one end of which is connected to a front end of said metal shell, and the other end of which is bent to oppose an outer surface of said insulator so as to form an air-gap therebetween while permitting creeping spark discharges running along said front end surface of said insulator, a forward edge portion of a front end surface of said ground electrode extending by 0.0~1.0 mm forward from said front end surface of said insulator, wherein an inner edge portion of said front end surface of said insulator which is subjected to the spark discharges from said ground electrode to said center electrode, is rounded by 0.1~1.0 (1/mm) in terms of radius of curvature (R).

22. A semi-creeping discharge type spark plug, comprising:

a cylindrical metal shell;

an insulator having an axial bore provided within said metal shell so that a front end of said insulator extends beyond said metal shell;

a center electrode provided within said axial bore of said insulator so that a front end surface edge of said center electrode is retracted by 0.1~0.6 mm from a front end surface of said insulator; and at least one ground electrode, one end of which is connected to a front end of said metal shell, and the other end of which is bent to oppose an outer surface of said insulator so as to form an air-gap therebetween while permitting creeping spark discharges running along said front end surface of said insulator, a forward edge portion of a front end surface of said ground electrode extending by 0.0~1.0 mm forward from said front end surface of said insulator, wherein an outer diameter of the front end of said center electrode is 1.0–2.0 mm, a front end portion of which opposes said ground electrode and is enclosed by said insulator; and wherein an inner edge portion of said front end surface of said insulator which is subjected to the spark discharges from said ground electrode to said center electrode, is rounded by 0.1~1.0 (1/mm) in terms of radius of curvature (R).

23. A semi-creeping discharge type spark plug according to claim 21, wherein a plurality of said ground electrodes are provided in a fashion to oppose said center electrode.

24. A semi-creeping discharge type spark plug according to claim 22, wherein a plurality of said ground electrodes are provided in a fashion to oppose said center electrode.

25. A semi-creeping discharge type spark plug according to claim 21, wherein a front end including a front end surface edge of said center electrode is made of a spark erosion resistant metal tip.

26. A semi-creeping discharge type spark plug according to claim 22, wherein a front end including a front end surface edge of said center electrode is made of a spark erosion resistant metal tip.

27. A semi-creeping discharge type spark plug according to claim 23, wherein a front end including a front end surface edge of said center electrode is made of a spark erosion resistant metal tip.

28. A semi-creeping discharge type spark plug according to claim 24, wherein a front end including a front end surface edge of said center electrode is made of a spark erosion resistant metal tip.

29. A semi-creeping discharge type spark plug according to claim 25, wherein said spark erosion resistant metal tip is formed by a metal selected from the group consisting of Pt, Pt-based alloy, Ir-based alloy and Ir—Rh based alloy.

30. A semi-creeping discharge type spark plug according to claim 26, wherein said spark erosion resistant metal tip is formed by a metal selected from the group consisting of Pt, Pt-based alloy, Ir-based alloy and Ir—Rh based alloy.

31. A semi-creeping discharge type spark plug according to claim 27, wherein said spark erosion resistant metal tip is formed by a metal selected from the group consisting of Pt, Pt-based alloy, Ir-based alloy and Ir—Rh based alloy.

32. A semi-creeping discharge type spark plug according to claim 28, wherein said spark erosion resistant metal tip is formed by a metal selected from the group consisting of Pt, Pt-based alloy, Ir-based alloy and Ir—Rh based alloy.

33. A semi-creeping discharge type spark plug according to claim 2, wherein said constricted portion of said insulator front end has a diameter of 3.0–4.0 mm.

34. A semi-creeping discharge type spark plug according to claim 1, wherein said constricted portion of said insulator front end has a diameter of 3.0–4.0 mm.

35. A semi-creeping discharge type spark plug comprising:

a cylindrical metal shell;

an insulator having an axial bore provided within said metal shell so that a front end of said insulator extends beyond said metal shell and having an inner edge portion of the front end surface of said insulator rounded by 0.1~1.0 (1/mm) in terms of radius of curvature (R);

a center electrode provided within said axial bore of said insulator so that a front end surface edge of said center electrode is retracted by 0.1~0.6 mm from a front end surface of said insulator; said center electrode having an erosion resistant metal tip made of a metal selected from the group consisting of Pt, Pt-based alloy, Ir-based alloy and Ir—Rh based alloy; and a plurality of ground electrodes, first ends of which are connected to a front end of said metal shell, and second ends of which are bent to oppose an outer surface of said insulator so as to form an air-gap therebetween while permitting creeping spark discharges running along said front end surface of said insulator, a forward edge portion of a front end surfaces of said ground electrodes extending by 0.0~1.0 mm forward from said front end surface of said insulator.

36. A semi-creeping discharge type spark plug comprising:

a cylindrical metal shell;

an insulator having an axial bore provided within said metal shell so that a front end of said insulator extends beyond said metal shell;

a center electrode provided within said axial bore of said insulator so that a front end surface edge of said center electrode is retracted by 0.1~0.6 mm from a front end surface of said insulator;

at least one ground electrode, one end of which is connected to a front end of said metal shell, and the other end of which is bent to oppose an outer surface of said insulator so as to form an air-gap therebetween while permitting creeping spark discharges running along said front end surface of said insulator, a forward edge portion of a front end surface of said ground electrode extending by 0.0~1.0 mm forward from said front end surface of said insulator; and an inner edge portion of said front end surface of said insulator which is subjected to the spark discharges from said ground electrode to said center electrode, being beveled in terms of chamfer length (C), the chamfer length (C) being defined as (t) mm<C<(t+0.1) mm, where (t) is a retraction length in which said front end surface edge of said center electrode is retracted from said front end surface of said insulator.

37. A semi-creeping discharge type spark plug comprising:

a cylindrical metal shell;

an insulator having an axial bore provided within said metal shell so that a front end of said insulator extends beyond said metal shell;

a center electrode provided within said axial bore of said insulator so that a front end surface edge of said center electrode is retracted by 0.1~0.6 mm from a front end surface of said insulator;

at least one ground electrode, one end of which is connected to a front end of said metal shell, and the other end of which is bent to oppose an outer surface of said insulator so as to form an air-gap therebetween while permitting creeping spark discharges running along said front end surface of said insulator, a forward edge portion of a front end surface of said ground electrode extending by 0.0~1.0 mm forward from said front end surface of said insulator; and an inner edge portion of said front end surfaces of said insulator which is subjected to the spark discharges from said ground electrode to said center electrode, being rounded in terms of radius of curvature (R), the radius of curvature (R) being defined as (t) mm<R<(t+0.1) mm, where (t) is a retraction length in which said front end surface edge of said center electrode is retracted from said front end surface of said insulator.

* * * * *